United States Patent [19]

Ernsberger

[11] Patent Number: 4,634,607

[45] Date of Patent: Jan. 6, 1987

[54] APPLYING DESIGNS TO AUTO EXTERIORS

[75] Inventor: Earl R. Ernsberger, Dublin, Pa.

[73] Assignee: Custon Auto Exteriors, Doylestown, Pa.

[21] Appl. No.: 753,929

[22] Filed: Jul. 11, 1985

Related U.S. Application Data

[63] Continuation-in-part of Ser. No. 510,644, Jul. 1, 1983, abandoned.

[51] Int. Cl.[4] ..... B05D 1/32

[52] U.S. Cl. ..... 427/282; 206/575; 427/272; 428/343

[58] Field of Search ..... 118/504, 505; 206/223, 206/224, 447, 460, 813, 575; 427/207.1, 208.2, 272, 282; 428/343, 351, 352; 101/127, 129

[56] References Cited

U.S. PATENT DOCUMENTS

| | | | |
|---|---|---|---|
| 2,554,791 | 5/1951 | Nickerson | 206/813 |
| 2,647,848 | 8/1953 | Douglas et al. | 206/447 |
| 2,883,044 | 4/1959 | Kendrick | 206/447 |
| 3,338,395 | 8/1967 | Silverstein | 206/460 |
| 3,509,991 | 5/1970 | Hurst | 206/813 |
| 3,568,829 | 3/1971 | Brady, Jr. | 206/447 |
| 3,665,889 | 5/1972 | Wagenvoord | 206/813 |
| 3,961,602 | 6/1976 | Dresser | 118/505 |
| 4,018,332 | 4/1977 | Benda | 206/223 |
| 4,055,249 | 10/1977 | Kojima | 206/447 |
| 4,397,261 | 8/1983 | Jones | 118/505 |
| 4,397,905 | 8/1983 | Dettmer et al. | 428/343 |
| 4,499,130 | 2/1985 | Questel et al. | 428/343 |

FOREIGN PATENT DOCUMENTS

| | | | |
|---|---|---|---|
| 0656309 | 1/1963 | Canada | 428/352 |
| 0676108 | 12/1963 | Canada | 428/343 |
| 0045269 | 9/1982 | Japan | 428/343 |
| 1349852 | 4/1974 | United Kingdom | 428/352 |

*Primary Examiner*—William Price
*Assistant Examiner*—Jimmy G. Foster
*Attorney, Agent, or Firm*—Joseph W. Molasky & Assocs.

[57] ABSTRACT

There is described a method and kit for enhancing the quality of designs to auto exteriors.

A uniquely thin mask and an improved paint composition provide means for reproducing designs of consistently high quality.

6 Claims, No Drawings

APPLYING DESIGNS TO AUTO EXTERIORS

This is a continuation-in-part of application Ser. No. 510,644, filed July 1, 1983, now abandoned.

This invention relates to a kit which may be used to apply lettering, numerals and various designs to the exteriors of automobiles, vans, trucks and the like.

This invention also describes an improvement in the known means for applying designs to vehicle exteriors by providing a precut mask in sheet form fabricated from polyvinyl chloride. The flexibility of said mask and its uniformly thin dimensions make it the ideal template by which to reproduce letters and designs of consistently high quality.

BACKGROUND

The application of lettering and designs to automobile exteriors is an expensive and time consuming process because it must be done professionally by hand and requires an extraordinary talent.

To make this procedure less expensive and less difficult stencils have been made available so that untrained individuals can apply decorative effects to vehicle exteriors with a minimum of effort. Unfortunately, stenciling still requires careful and accurate work and the templates available for this purpose are of such poor quality that the stenciling process often results in an unprofessional-looking design.

Moreover, the paints provided in auto stenciling kits generally require long drying periods as a result of which there is an opportunity for the paint surface to absorb dirt and other particles from the atmosphere. To avoid this occurrence blotters are sometimes used to absorb excess paint but this only serves to introduce foreign particles into the paint and thus afford a design which is gritty or uneven in texture and unprofessional in appearance.

THE INVENTION

It is an object of this invention to provide an auto design kit which will afford the reproduction of high quality designs and lettering on vehicle exteriors.

It is another object of this invention to provide an auto design kit which includes a mask precut from uniformly thin sheets of polyvinyl chloride.

It is a further object of this invention to provide an auto design kit in which said mask is coated on one side with a rubber based adhesive covered by a disposable liner.

It is still another object of this invention to provide an auto design kit in which said mask is so pliant and uniquely thin and the designs so finely cut that they provide a consistently clear and accurate reproduction.

These and other objects will be apparent from the following description which sets forth with particularity the components of a typical auto design kit:

(1) a lettering mask consisting of precut letters numerals and/or designs fabricated from polyvinyl chloride in sheet form. Said mask alone has a thickness of from about 1.75–2.50 mils and it is impregnated on one side with a rubber based adhesive covered by a disposable liner;

(2) a heavily pigmented enamel having a high concentration of drying oils; and (3) a brush having cylindrical-shaped bristles.

The adhesive bonded to said mask is a natural latex rubber having an essentially uniform thickness of from about 0.25–0.75 mils. Said adhesive exhibits high initial tack and it exerts an adhesive strength of about 25 ounces per square inch. Its tensile strength is approximately 22 pounds per square inch and it is characterized by an elongation of about 40%. In combination, said mask and said adhesive combine to afford a dual-layer sheet having a thickness of from about 2–3 mils.

The exposed surface of the adhesive layer is covered by a disposable liner having a thickness of from about 1.75–2.75 mils. Said liner may be fabricated from any suitable sheet material as, for example, paper having a high tensile strength or vinyl or the like.

A chosen design is reproduced by first cleansing the selected areas thoroughly. Ideally, the surface is prepared by first washing with a suitable cleansing agent such as Surfa Prep, a product manufactured by Chemical Products Company, Inc., Old Post Road, P.O. Box 440, Aberdeen, Md., 21001. The washed area is then wiped dry with a soft cloth and denatured alcohol is applied to ensure the removal of any film or residue which may have resulted from the use of the cleansing agent. Thereafter, the surface is again dried with a soft dry cloth.

The selected mask is impressed onto the cleansed surface after first removing the liner which covers the adhesive layer. Said mask is applied with even pressure to ensure complete adhesion and preclude the seepage or running of paint beneath the cutout areas.

The paint employed is a heavily pigmented oil based acrylic composition containing high concentrations of drying agents. For this purpose I have found it desirable to use "Sign Painter's Chromatic Lettering Enamel" ("Sign Painter's Chromatic Lettering Enamel" is a product of Chromatic Paint Corporation, Carnersville, N.Y.). Said enamel is uniquely suitable for the reproduction of fine lettering and designs because it combines the advantages of high opacity with fast drying and easy cleanup; moreover, it may be thinned with mineral spirits if a less viscous composition is desired. It dries quickly at temperatures above 25° C. and provides a durable finish having a long lasting lustre.

For best results it is preferred to employ brushes in which all bristles are cut to the same length and form a circular flat surface at their ends. Only the flat bottom of said bristles are dipped into the paint and overloading is avoided. Before applying the paint it is desirable to pounce the bristles onto a clean sheet so as to uniformly disperse the paint throughout. The loaded brush is ready for use when the paint on said sheet is evenly distributed.

The loaded brush is held perpendicular to the mask and it is brought down on the cutout design in a rapid up-and-down motion until the cutout portions are completely covered with paint. After the paint has dried the mask is carefully removed and, if desired, it may be cleansed and used again in another application.

This invention has been described by reference to specific embodiments; however, it will be appreciated by those skilled in the art that various modifications may be made in the kit and procedures herein described without departing from the spirit or scope of this invention. Accordingly, any modifications which are within the skill of the artisan to effect should be considered as falling within the scope of the appended claims.

What is claimed is:

1. A method for applying designs to an auto body which comprises:

(1) securing on said auto body a precut mask fabricated from a polyvinyl chloride sheet to which has been applied on one side a rubber based adhesive, said sheet having a thickness of from about 1.75–2.50 mils; and (2) brushing onto and within said mask a heavily pigmented enamel having a high concentration of drying oils.

2. The method according to claim 1 wherein said adhesive is natural latex rubber applied in an essentially uniform thickness of from about 0.25–0.75 mils.

3. The method according to claim 2 wherein said adhesive has a tensile strength of about 22 pounds per square inch and an elongation valve of about 40%.

4. The method according to claim 1 wherein said adhesive has an adhesive strength of about 25 ounces per square inch.

5. The method according to claim 1 wherein said enamel is an oil based acrylic.

6. A method according to claim 1 wherein said adhesive is covered by a disposable liner.

* * * * *